US005467902A

United States Patent [19]

Yquel

[11] Patent Number: 5,467,902

[45] Date of Patent: Nov. 21, 1995

[54] AEROSOL DEVICE FOR DISPENSING A COMPOSITION WITH RELATIVELY HIGH VISCOSITY

[75] Inventor: Jean-Pierre Yquel, Colombes, France

[73] Assignee: L'Oreal, Paris, France

[21] Appl. No.: 232,263

[22] PCT Filed: Dec. 1, 1992

[86] PCT No.: PCT/FR92/01117

§ 371 Date: May 6, 1994

§ 102(e) Date: May 6, 1994

[87] PCT Pub. No.: WO/93/11058

PCT Pub. Date: Oct. 6, 1993

[30] Foreign Application Priority Data

Dec. 2, 1991 [FR] France ..... 91 14915

[51] Int. Cl.[6] ..... B65D 83/00

[52] U.S. Cl. ..... 222/402.1; 222/464.1

[58] Field of Search ..... 222/190, 402.1, 222/394, 464

[56] References Cited

U.S. PATENT DOCUMENTS 2,837,375 6/1958 Efford et al. .

3,541,581 11/1970 Monson .

4,019,657 4/1977 Spitzer et al. .

4,853,430 8/1989 Stuhler et al. .

5,032,619 7/1991 Frutin et al. ..... 222/402.1 X

FOREIGN PATENT DOCUMENTS 0234797 9/1987 European Pat. Off. .

3037907 5/1982 Germany .

*Primary Examiner*—Gregory L. Huson

*Attorney, Agent, or Firm*—Young & Thompson

[57] ABSTRACT

An aerosol device for dispensing a composition with relatively high viscosity, in particular a gel or an emulsion, comprises a can intended to be used with the head upwards, containing the composition and a propellant agent acting directly on the composition. A dispensing valve is in the upper part of the can on an opening of this can, while a dip-tube connected to the valve extends as far as the vicinity of the bottom of the can. The composition (C) to be dispensed has a viscosity (measured on a Brookfield DV III viscometer, needle no. 7) lying in the range of 4000 to 10,000 millipascal.second, preferably of 6000 to 8000 millipascal.second, for a speed of 100 revolutions/minute and of 30,000 to 150,000 millipascal.second, preferably of 50,000 to 120,000 millipascal.second, for a speed of 2.5 revolutions/minute. The dip-tube is a semi-capillary tube (18) whose internal diameter (e) lies between 0.7 and 1.5 mm.

5 Claims, 1 Drawing Sheet

AEROSOL DEVICE FOR DISPENSING A COMPOSITION WITH RELATIVELY HIGH VISCOSITY

FIELD OF THE INVENTION

The invention relates to an aerosol device for dispensing a composition with a relatively high viscosity, in particular a gel or an emulsion, of the type of those which comprise a can, intended to be used with the head upwards, containing the composition and a pressurized gaseous propellant agent acting directly on the composition, a dispensing valve being placed on an opening at the upper part of the can, while a dip-tube connected to the valve extends as far as the vicinity of the bottom of the can.

THE KNOWN PRIOR ART

U.S. Pat. No. 3,541,581 shows, in particular in FIG. 5, an aerosol device of this kind, in which no physical separation is provided between the pressurized gaseous propellant agent and the composition to be dispensed.

Such an aerosol device is not entirely satisfactory when the viscosity of the composition to be dispensed is relatively high. FR-A-2,223,452 emphasizes the difficulties and the problems of operation encountered in such a situation. The viscous composition does not flow evenly in the dip-tube and cavitation phenomena with loss of propellant gas through the dispensing valve occur. This results in a substantial decrease in the emptying ratio (ratio of the maximum quantity of composition dispensed by the device to the total mass of this composition introduced into the can).

In order to overcome such drawbacks, FR-A-2,223,452 proposes stable gel compositions with retarded foaming having a relatively low flow threshold, which corresponds to a viscosity which is also relatively low.

This solution, which rules out more viscous compositions, but nevertheless being of great interest, in particular as regards self-foaming shaving gels, aims to promote the flow of the composition in the dip-tube and in the valve in order to reduce the cavitation phenomena.

Such an approach is understandable because it is known that, in order to promote the flow of a product in a set of tubes and pipelines, it is generally suitable either to decrease the viscosity of the product while keeping the passage cross-sections constant, or to increase the passage cross-sections if the viscosity of the product cannot be altered.

OBJECT OF THE INVENTION

The object of the invention is above all to provide an aerosol device of the type previously defined which makes it possible to improve the flow of the composition while avoiding or at the very least while reducing the cavitation phenomena and while improving the emptying ratio without having to reduce the viscosity of the composition to be dispensed.

SUMMARY OF THE INVENTION

According to the invention, an aerosol device of the type defined previously is characterized in that the composition to be dispensed has a viscosity (measured on a Brookfield DV III viscometer, needle no. 7) lying in the range of 4000 to 10,000 millipascal.second, preferably of 6000 to 8000 millipascal.second, for a speed of 100 revolutions/minute and of 30,000 to 150,000 millipascal.second, preferably of 50,000 to 120,000 pascal.second, for a speed of 2.5 revolutions/minute, and in that the dip-tube consists of a semi-capillary tube whose internal diameter lies between 0.7 and 1.5 mm and preferably between 1.3 and 1.5 mm.

The invention, surprisingly and unexpectedly, makes it possible to improve the flow conditions of a viscous product, from the point of view of the evenness of this flow and of the decrease or even the elimination of cavitation phenomena, by providing a reduced passage cross-section, in contrast to what might be thought.

Tests carried out with an aerosol device according to this embodiment have made it possible to obtain, in certain cases, an emptying ratio of more than 80% during continuous dispensing, and the emptying ratio is improved in all cases, in comparison with a device equipped with a valve of the same type but with a normal dip-tube whose diameter is greater than the values indicated hereinabove, by at least 10% absolute.

The valve is fitted with a tail which includes a cylindrical housing in which the upper end of the semicapillary tube is engaged, the outer surface of which bears against the inner surface of the housing.

BRIEF DESCRIPTION OF THE DRAWING

The invention consists, apart from the arrangements explained hereinabove, in a certain number of other arrangements which will be dealt with more explicity hereinbelow with regard to embodiments described with reference to the attached drawing which is, however, in no way limiting.

DETAILED DESCRIPTION OF THE INVENTION

Figure 1:
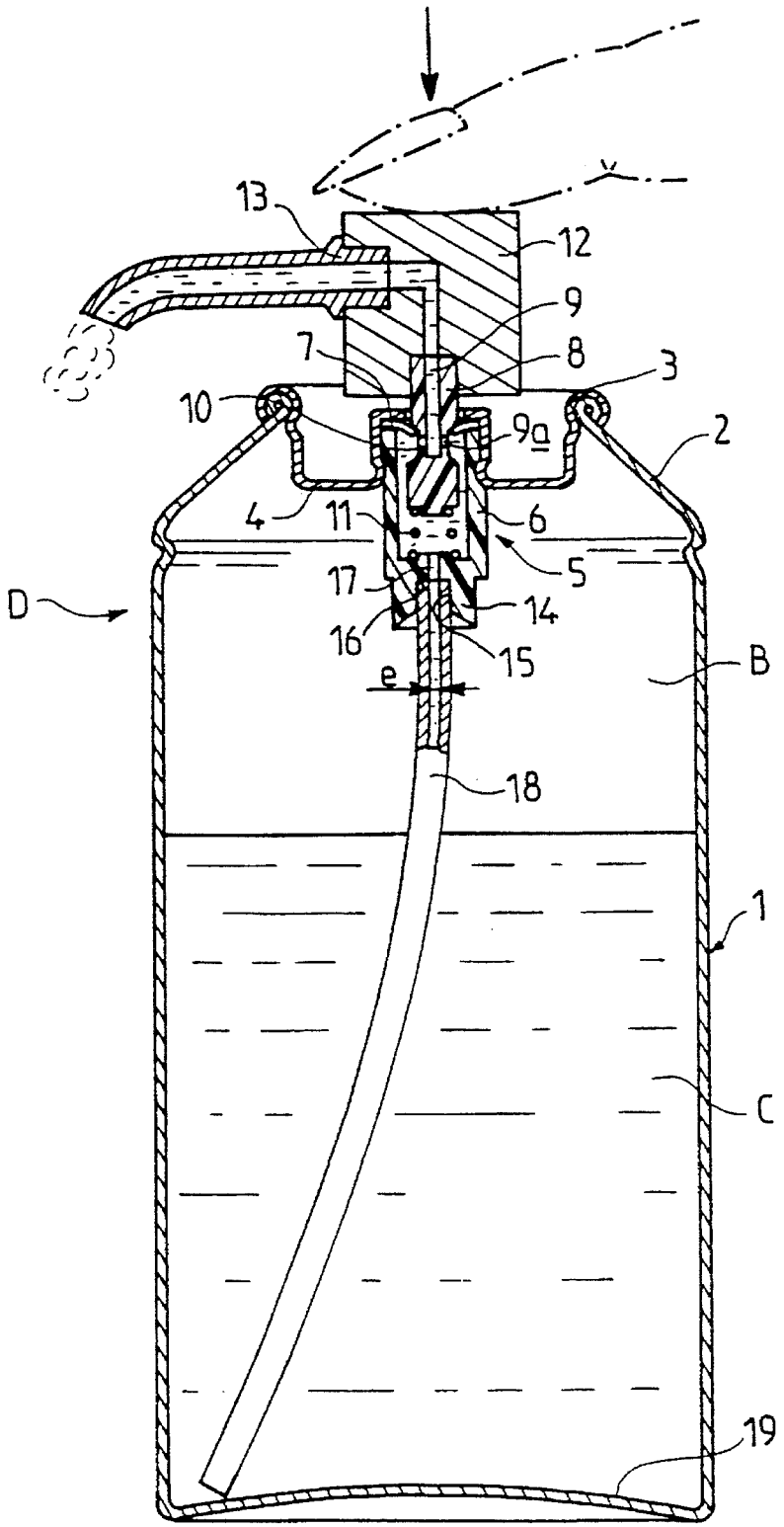
FIG. 1 of this drawing is a view in vertical section of an aerosol device according to a first embodiment of the invention, represented during dispensing.

Referring to FIG. 1 of the drawing, an aerosol device D can be seen for dispensing a composition C with relatively high viscosity. The composition C consists, in particular, of a self-foaming shaving gel or of a thickened emulsion.

The viscosity of the composition C, measured on a Brookfield DV III viscometer, needle No. 7, lies in the range of 4000 to 10,000 millipascal.second, preferably of 6000 to 8000 millipascal.second, measured at a speed of 100 revolutions/minute and of 30,000 to 150,000 millipascal.second, preferably of 50,000 to 120,000 millipascal.second, measured at a speed of 2.5 revolutions/minute.

The device D comprises a can 1 intended to be used with the head 2 upwards. The can 1 contains the composition and a gaseous propellant agent B which acts directly on the composition C. In other words, no physical separation is provided between the gaseous propellant agent B and the composition C. The propellant agent advantageously consists of a pressurized gas belonging to the group formed by: air, nitrogen, or a liquefiable propellant which is highly insoluble in the composition, such as 2-H-heptafluoropropane, more widely known by the classification HCFC 227. Use of a liquefied gas capable of dissolving in the composition is avoided.

The head 2 of the can 1 has a frustoconical shape and is provided, at its upper end, with an opening 3 having a rolled edge. A valve collar 4 is crimped onto the edge of this opening and a dispensing valve is fixed to the center of the collar 4. The valve 5 comprises a valve body 6 around which the central part of the collar 4 is crimped.

An elastic sealing washer 7 is clamped between the front end of the valve body 6 and a rim of the central part of the collar 4. A rod 8 can slide axially in the valve body 6, this rod projecting outwards. The rod 8 includes a central channel 9 emerging upwards, the inner end of which is axially closed; this channel 9 communicates through radial passages 9*a* (or valve orifices) with a peripheral groove 10. The circular inner edge of the washer 7 is engaged in this groove 10. When the rod 8 is not pushed in, the washer 7 closes the radially directed passage or passages 9*a* and isolates the inside of the can 1 from the channel 9. On the other hand, when the rod 8 is pushed in, the washer 7 bends in its central part and allows communication between the inside of the can 1 and the channel 9, as shown in FIG. 1.

The rod 8 is returned upwards into the closure position by a coil spring 11 arranged between the bottom of the housing provided in the body 6 and the rod 8. There is a push button 12 equipped with a dispensing nozzle 13 on top of the upper end of the rod 8.

At its lower part, the valve body 6 is extended downwards by a valve tail 14, inside which a cylindrical housing 15 is provided, this housing being limited, towards the top, by an inner radial shoulder 16. An axial passage 17 of relatively large diameter, in particular greater than 1 mm, connects the housing 15 with the chamber in which the rod 8 can move.

A semi-capillary dip-tube 18 is engaged by its upper end in the housing 15 and extends downwards as far as the vicinity of the bottom 19 of the can 1.

The internal diameter e of the tube 18 lies between 0.7 mm and 1.5 mm and preferably between 1.3 and 1.5 mm. This cross-section of reduced diameter lies upstream of the valve orifices 9*a*.

Surprisingly, with compositions whose viscosity (measured on a Brookfield DV III viscometer, needle no. 7) lies within the following range: from 4000 to 10,000 millipascal.second, preferably from 6000 to 8000 millipascal.second, at a speed of 100 revolutions/minute and from 30,000 to 150,000 millipascal.second, preferably 50,000 to 120,000 millipascal.second, at a speed of 2.5 revolutions/minute, the dispenser device equipped with a semi-capillary tube 18 allows, by pressing on the push button 12, as illustrated in FIG. 1, even dispensing of the product through the nozzle 13, and reduced losses of gaseous propellant agent.

The emptying ratio obtained during continuous dispensing, in certain cases, may be greater than 80%. The emptying ratio which is obtained with the same type of valve, but with a normal dip-tube whose internal diameter is markedly greater than 1.5 mm, may be lower in absolute terms by 10 points (ratio of approximately 70%).

The pressure of the propellant agent at the start of the spraying, in the case of a compressed gas, generally lies between 5 and 10 bar, this pressure being preferably equal to 7 bar. In the case of 2-H-heptafluoropropane (liquefied propellant agent), the pressure is approximately 3.5 bar.

With the device of the invention, and the viscosity ranges indicated hereinabove, the initial delivery rate of the composition lies between 1 g/s and 6.5 g/s, preferably between 2 g/s and 4 g/s, inclusive of the end points.

The final composition delivery rate, at approximately 80% emptying, remains greater than 1 g/s.

Tests on the dispensing of a composition with relatively high viscosity as defined previously, with the device of the invention, made it possible to release a correct product and with a satisfactory emptying ratio, despite high viscosity variations observed as a function of the speed.

I claim:

1. Aerosol device for dispensing a composition with relatively high viscosity, in particular a gel or an emulsion, comprising a can intended to be used with the head upwards, containing the composition and a pressurized gaseous propellant agent acting directly on the composition, a dispensing valve being placed at the upper part of the can on an opening of this can, while a dip-tube connected to the valve extends as far as the vicinity of the bottom of the can, characterized in that the composition (C) to be dispensed has a viscosity (measured on a Brookfield DV III viscometer, needle no. 7) lying in the range of 4000 to 10,000 millipascal.second, preferably of 6000 to 8000 millipascal.second, for a speed of 100 revolutions/minute and of 30,000 to 150,000 millipascal.second, preferably of 50,000 to 120,000 millipascal.second, for a speed of 2.5 revolutions/minute, and in that the dip-tube consists of a semi-capillary tube (18) whose internal diameter (e) lies between 0.7 and 1.5 mm.

2. Device according to claim 1, characterized in that the internal diameter of the semi-capillary tube (18) lies between 1.3 and 1.5 mm.

3. Device according to claim 1 or 2, characterized in that the valve (5) is fitted with a tail (14) which includes a cylindrical housing (15) in which the upper end of the capillary tube (18) is engaged, the outer surface of which bears against the inner surface of the housing (15).

4. Device according to claim 1, characterized in that its emptying ratio is at least 80%.

5. Device according to claim 1, characterized in that the pressure of the propellant agent in the case of a compressed gas lies between 5 and 10 bar, while in the case of the propellant agent being liquid-phase 2-H-heptafluoropropane, the pressure is approximately 3.5 bar, and in that the initial composition delivery rate lies between 1 g/s and 6.5 g/s.

* * * * *